US005729213A

United States Patent [19]

Ferrari et al.

[11] Patent Number: 5,729,213

[45] Date of Patent: Mar. 17, 1998

[54] TRAIN WARNING SYSTEM

[76] Inventors: John S. Ferrari; David S. McFarland, both of 8448 W. Union Ave. #24, Littleton, Colo. 80123

[21] Appl. No.: 517,188

[22] Filed: Aug. 21, 1995

[51] Int. Cl.[6] ..... G08G 1/00

[52] U.S. Cl. ..... 340/901; 340/902; 340/903; 246/122 R

[58] Field of Search ..... 340/901–903, 340/907, 933, 539, 988, 937; 246/125, 126, 473 R, 473.1, 122 R, 207; 348/118, 148

[56] References Cited

U.S. PATENT DOCUMENTS

| | | | |
|---|---|---|---|
| 3,758,775 | 9/1973 | Hopkins | 340/933 |
| 4,207,569 | 6/1980 | Meyer | 343/6.5 R |
| 4,611,198 | 9/1986 | Levinson et al. | 340/539 |
| 4,621,252 | 11/1986 | Johns et al. | 340/903 |
| 4,942,395 | 7/1990 | Ferrari et al. | 340/907 |
| 5,493,642 | 2/1996 | Dunsmuir et al. | 395/161 |
| 5,554,982 | 9/1996 | Shirkey et al. | 340/903 |

*Primary Examiner*—Brent A. Swarthout
*Assistant Examiner*—Van T. Trieu

[57] ABSTRACT

A compact railroad/highway crossing motorist warning device comprising; a rail track mounted pressure sensor switch assembly which timely activates and deactivates a radio frequency transmitter beacon located upon the cross-buck at the rail crossing, the beacon transmits recordable audio and video signals and: a series of mobile sympathetic radio signal receiver units, for highway motor in vehicle and in locomotive application, the in motor vehicle receiver is hardwired to the motor vehicle and the in locomotive receiver has an event recording means attached.

4 Claims, 3 Drawing Sheets

TRAIN WARNING SYSTEM

FIELD OF THE INVENTION

The present invention relates to a compact, radio frequency railroad/highway crossing safety improvement, for motor vehicle and rail use.

BACKGROUND OF THE INVENTION

With the proliferation of high powered automobiles that have become available to the motoring public, it has become apparent that a means to provide a reliable extension of personal highway condition perception is presently necessary to protect a motor vehicle and occupants from deadly harm. This extension of perception is extremely important in the area of rail/highway crossings, as many of these crossings are presently unmarked or unguarded.

Present day automobile manufacturers are building sound proof, insulated vehicles for the motoring consumer, effectively isolating the operator from outside sound sources. Additionally, emergency vehicles or priority vehicles sometimes cannot hear the locomotive horn blast, even when the locomotive is in near proximity.

Further, any highway vehicle with pitted or defective windshields sometimes have the drivers vision hindered and cannot clearly see when driving toward the sun, and adverse weather conditions such as heavy rain or heavy snow will limit a motor vehicle operators field of view.

With the advent of high speed rail travel in the United States, safer locomotive operations now requires the implementation of a reliable motorist warning system, operating in addition to the present crossing guards, and locomotive horn signals. The motoring public desires a discreet device, that will not detract from the beauty of the automobile, and will not interfere with safe and efficient vehicle operations. The common radar detector is an example of the motoring public's willingness to procure and attentively operate reliable in vehicle warning systems.

In the recent and the distant past, inventors have attempted to provide for motorist warning means as is illustrated by the following prior art references following; The invention of John B. Hopkins disclosed in U.S. Pat. No. 3,758,775 presents a 2 part microwave railroad crossing signaling system which trigger is resident on the trackage and a transmitter communicates with a ground mounted light display. Found in the U.S. Pat. No. 4,621,252 issued to Johns et al is an in-vehicle warning device coupled to a bridge mounted transmitter which continually transmits bridge height information.

The present invention provides an improvement and addition to the three-piece, compact wireless railroad grade motorist warning device disclosed in U.S. Pat. No. 4,942,395, and is constructed in unity and with relevance to that U.S. Pat. No. 4,942,395, issued to McFarland, Ferrari, and Sommers, your petitioners who present the present invention.

The railroad grade crossing motorist warning system as depicted in that patent document comprises: a locomotive mounted transceiver which communicates with a like transceiver that is mounted at a railroad grade crossing. Upon verified receipt of a signal from the approaching locomotive, the grade crossing transceiver "beacon" emits a coded radio frequency signal which is to be received by local motorists equipped with in-vehicle sympathetic receivers.

Upon signal reception from the crossing "beacon" an audio/visual alert is presented to the motor vehicle operator, alerting to the presence of the locomotive-occupied crossing. Additionally, the locomotive operator receives a signal from the crossing "beacon" which verifies the activation of the system, an important railroad operational safety measure.

As is outlined in the disclosure document #360,569 of Aug. 18 1994, submitted to the U.S. Patent Office, McFarland, Ferrari, and Sommers have discovered that it is possible to activate the grade crossing mounted transmitter identified in their patent with a pressure sensor electrical switch mounted to the railroad trackage, and connected to an electrical circuit present at a rail/highway crossing site, in lieu of the locomotive transmitter activator. Further, the same pressure sensor electrical switch serves to timely de-activate the present invention grade crossing transmitter, and are important for cost savings and simplicity of construction.

Additionally, it has become apparent that the grade crossing transmitter may be triggered and activated by a magnetic sensor electrical switch mounted to the railroad trackage, in the same manner.

With the adoption of either of these triggering devices mounted to the railroad trackage, the elimination of the receiver element on the grade crossing becomes possible, as the crossbuck mounted grade crossing unit needs to only transmit as a "beacon" to the motor vehicle and locomotive. Further, the elimination of the transmitter unit on the locomotive is possible, as the locomotive mass upon the track will activate the crossing "beacon" transmitter.

Further, McFarland, Ferrari and Sommers have discovered that mounting the sympathetic receiver of the present invention within the motor vehicle, and placing the receiver atop or incorporating it within the rear-view mirror provides for an improvement in motor vehicle operator notification. An audio/visual alert signal such as is provided in the present invention will bring the operators attention up towards the rear view mirror area, thus encouraging the operator to look forwardly by default, allowing for increased operator road perception.

Therefore, it is a primary object of the present invention to overcome deficiencies in the foregoing art, and improve rail/highway safety by providing a simplified, reliable, rail/highway crossing mounted radio frequency transmitter beacon which beacon is activated and deactivated by a rail track mounted sensor switch, and the beacon presents an audio and video radio signal which is communicable to any outlying sympathetic receivers within motor vehicles or locomotives in near proximity to the beacon.

A further object of the present invention is to provide motor vehicle operators with a hardwired, rear view mirror mounted audio-visual display panel which presents the motor vehicle operator with a multiplicity of warning messages, (simulated voice chip and illuminated display) that are related to the present invention.

Another object of the present invention is to provide locomotive operators an in-cab audio/visual display panel which presents locomotive operators with a reliable warning system and in-cab crossing transmitter activation notice which is connected to a flight recorder type recording device, and such a recording device will provide a further on-board record of system events and activation.

It is a further object of the present invention to provide for a railroad crossbuck mounted to transmitter beacon with an attached video camera, which is capable of simultaneously transmitting a radio signal to sympathetic receivers nearby, and engaging a centralized dedicated recording station, for verification of signal activation recording, and the multiplex radio wave and video camera on a chip signal is recordable by the central recording station, to provide a hard record of system activation location, times, and dates.

SUMMARY OF THE INVENTION

The present invention is a novel approach to the provision of an improved, durable, miniature wireless alert system for vehicle operator safety. The present inventions warning transmitter beacon is attached to crossbucks at railroad crossings for vehicle and locomotive operator alert, and when active, will immediately signal to any sympathetic receivers nearby, to provide vehicle operators with an audio/visual alert signal and indication of an approaching locomotive or live railroad crossing within the transmitter beacon radio range. To this end, all railroad crossing warning transmitter beacons per the present invention would broadcast a coded multiplex radio signal at precisely the same frequency and at the legal power limit. The output radio signal from the transmitter beacon may also be co-broadcast within the Emergency Broadcast System or Emergency Alert Frequencies.

In the preferred embodiment of the present invention for vehicle operator alert of guarded railroad crossings (those crossings with active warning means installed), a vandal and weatherproofed transmitter unit per the present invention is mounted upon the crossbuck mounting pole, and the transmitter is hardwired to the crossings existing electrical circuit. The transmitter is intermittently active. The transmitter may have a visual display producing video chip installed for enhanced visual notification of a centralized recording station. This video chip is similar to the camera on a chip, Mobile View Unit as is produced by TVX Inc., Golden Colorado. The transmitter is activated and deactivated by means of pressure or magnetic sensors which are permanently affixed to the railroad trackage, and these sensors detect the presence of a locomotive or rail traffic. The sensors are coupled to electrical switches, which interrupt or complete an electrical circuit, which supplies electricity to the transmitter. Preferably, electricity is provided at the crossing by existing circuits. Upon completion of locomotive and train unit passage, the sensor array terminates contact, and the transmitter reverts to an off or "standby" condition, and does not transmit a signal.

An alternative embodiment of the present invention for vehicle operator alert concerning passive, unguarded railroad crossings (those crossings with no warning signals of an active nature), would consist of a vandal and weatherproofed transmitter unit per the present invention which is mounted upon the crossbuck mounting pole, and the transmitter is powered by a long-life battery and has photovoltaic trickle charging panels integrally provided for dependable transmitter operation, and the transmitter is intermittently active. The transmitter may have a visual display producing video chip (similar to the camera on a chip Mobile View Unit produced by TVX Inc. of Golden Colorado) installed for enhanced visual notification of a centralized recording station. The transmitter is activated and deactivated by means of the same aforesaid pressure or magnetic sensors which are permanently affixed to the railroad trackage, and these sensors detect the presence of a locomotive or rail traffic. The sensors are also powered by the battery/photovoltaic electrical system, and operate independent of the railroad electrical system that may be available at the trackage itself. Upon completion of locomotive and train unit passage, the sensor array terminates contact, and the transmitter reverts to an off or "standby" condition, and does not transmit a signal.

In the present invention, the motor vehicle receiver is preferably incorporated within and internal to the mirror assembly, and would serve as a replacement retrofit rear view mirror. Alternatively, the receiver is embodied as an attachment to the vehicles rear view mirror. A multiplicity of illuminated visual display symbols are placed on the forward face of the receiver, and these symbols correspond to the activation of the rail crossing transmitter, and "other" priority vehicles. A variable volume simulated voice chip type audio alert is also incorporated within the present receiver, and audibly notifies the vehicle operator to the activation of the receiver by stating a phrase such as "Locomotive Approaching" or similar. The visual and audio portions of the receiver operate simultaneously, and the receiver is hardwired to the vehicles electrical system, so that it is constantly energized when the vehicle is operating. The motor vehicle receiver is additionally capable of receiving incoming radio frequency warning signals from the Emergency Broadcast System or Emergency Alert Frequencies, and Differential Global Positioning System, as necessary.

The locomotive mounted receiver per the present invention is mounted to the interior operators cab of the locomotive. An illuminated visual display symbol is placed on the forward face of the receiver, and this symbol corresponds to the activation of the rail crossing transmitter. A variable volume simulated voice chip type audio alert is also incorporated within the present receiver, and audibly notifies the locomotive operator to the activation of the receiver by stating a phrase such as "Warning System Activated" or similar. The visual and audio portions of the receiver operate simultaneously, and the receiver is hardwired to the locomotive electrical system, so that it may be constantly energized when the locomotive is operating. The locomotive receiver is attached to a separate recording device, similar in function to an onboard flight recorder, so as to record locomotive approach activations of the warning beacon transmitter per the present invention.

Despite the various means which presently exist for advance alert to vehicle operators of mediate hazards (i.e., railroad crossing lights, bells and active guards), there still remains a very real need for useful and novel technologies which address the increasing safety needs of the motoring public and highway vehicle operators. The novel present invention provides hazardous material carders, commercial carders, motor vehicle operators, priority vehicle operators, and locomotive operators with an in-vehicle warning device which presents identifiable visual/audio alert signals to provide for verified advance notification and collision avoidance, and it is dependable, durable, miniature, is adaptable to many crossing situations, and it is economical to manufacture and maintain.

DETAILED DESCRIPTION OF THE DRAWINGS

Figure 1:
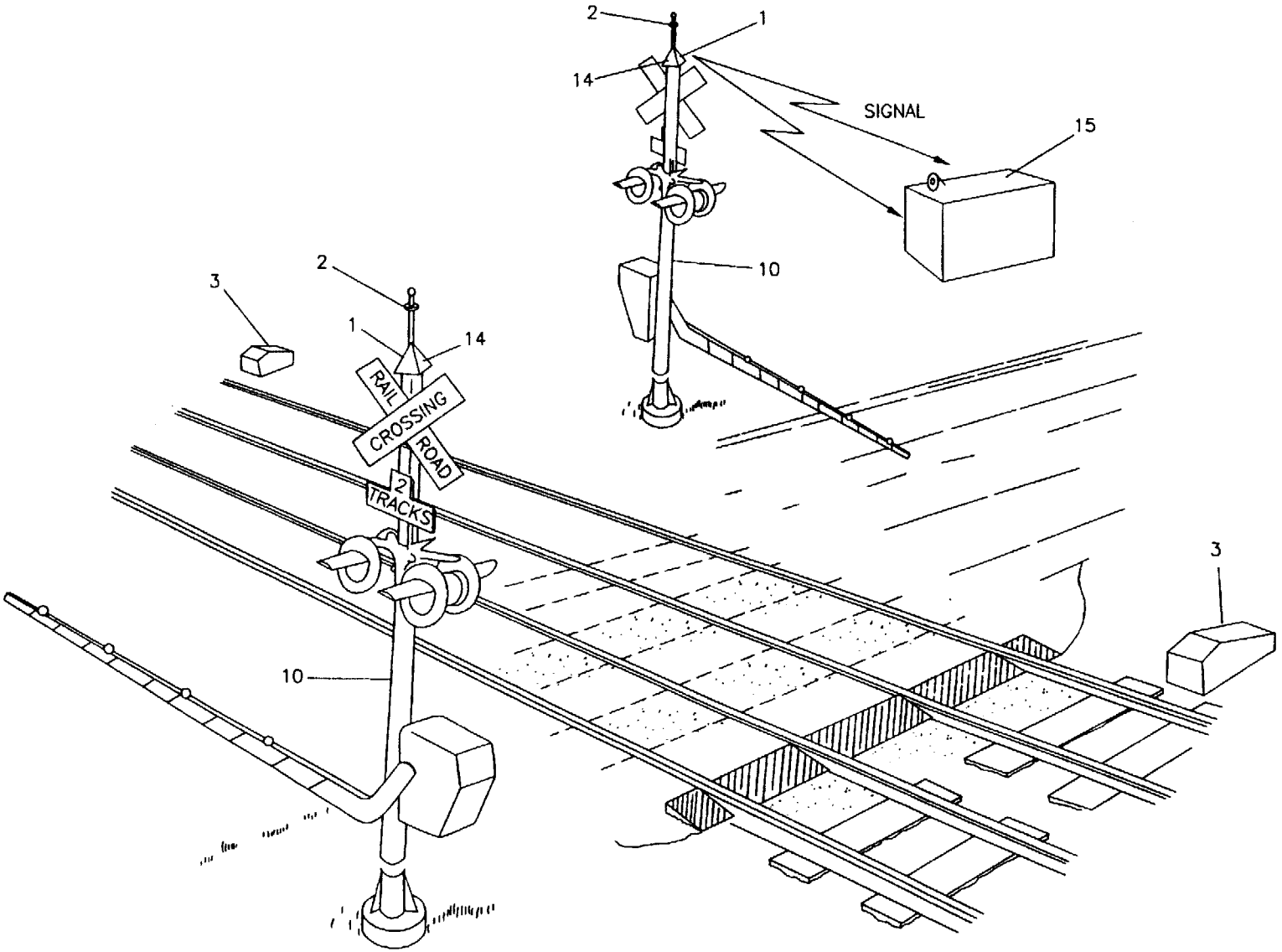
FIG. 1 is an elevational view of a railroad track/highway crossing, illustrating the present invention transmitter beacon located upon an "active" crossbuck, showing placement of sensor switches upon rail trackage, and depicting placement of video camera on a chip upon beacon.
Figure 2:
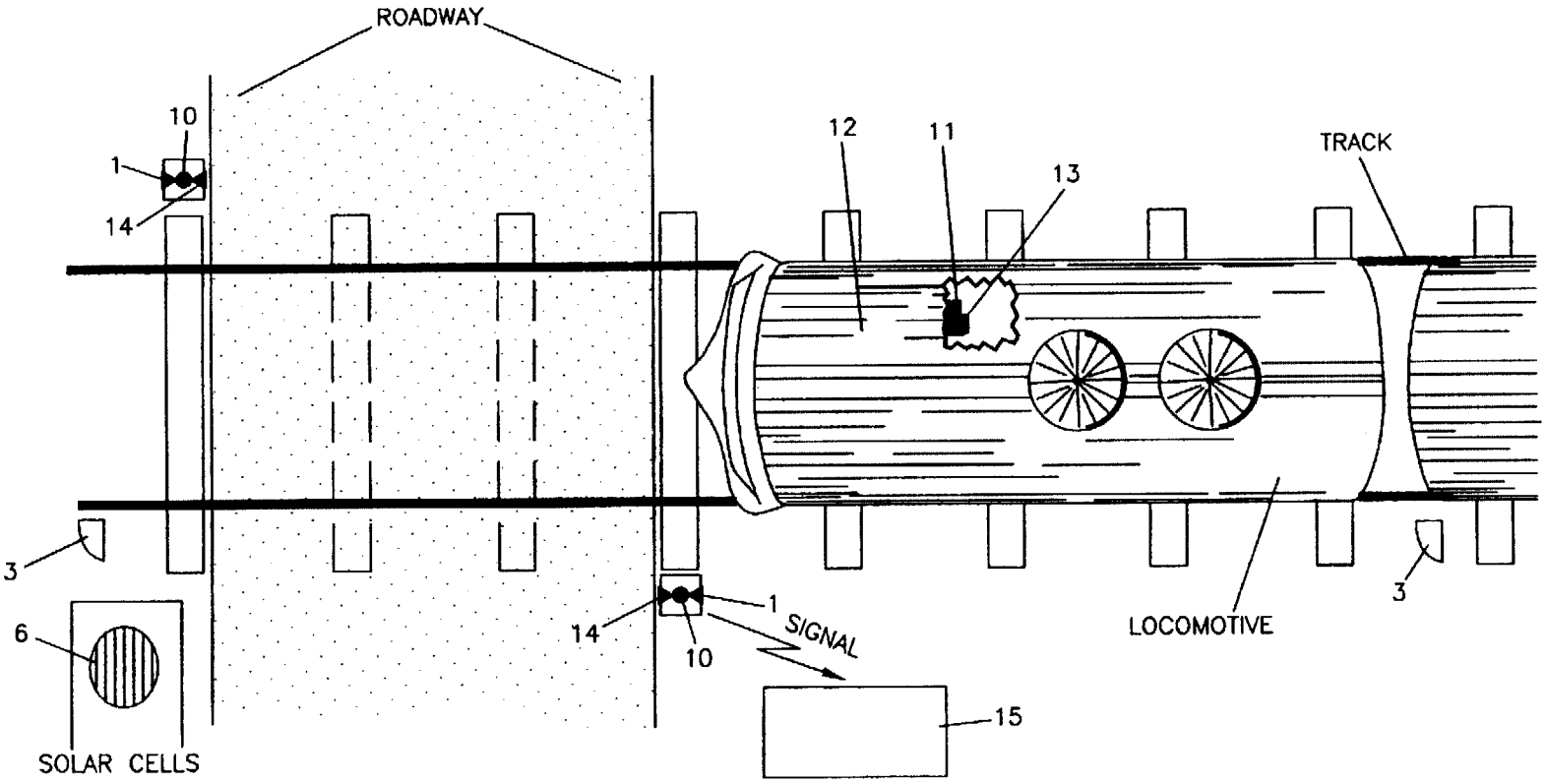
FIG. 2 is a top cutaway view era locomotive with an onboard receiver, approaching a rail/highway crossing equipped with crossbuck mounted transmitter, illustrating locomotive receiver mounted recording device, and showing path to dedicated central recording station from beacon.
Figure 3:
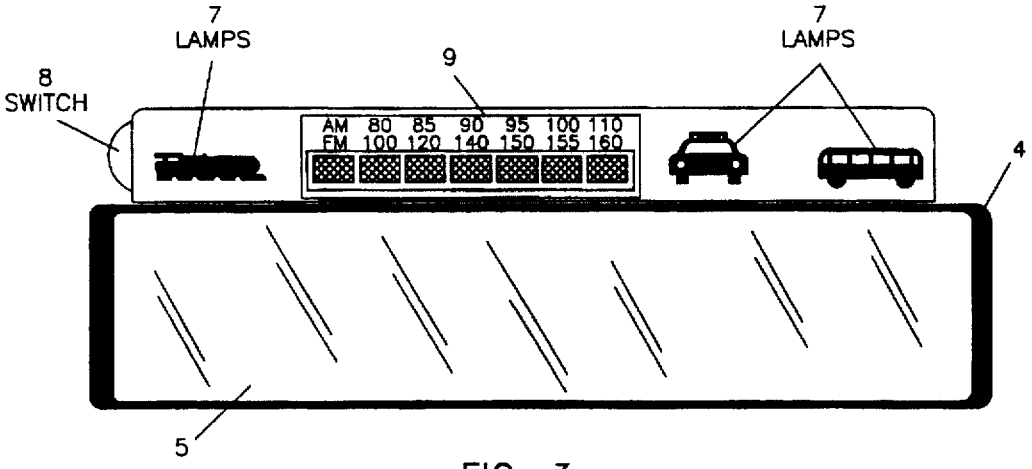
FIG. 3 is a front elevational view of an in-vehicle mobile receiver unit for motor vehicle use.
Figure 4:
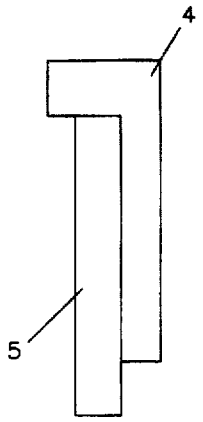
FIG. 4 is a side elevational view of an in-vehicle mobile receiver unit for motor vehicle use.

The present invention in the preferred embodiment comprises a compact wireless railroad/highway crossing safety warning system which alerts motor vehicle operators and locomotive operators to potentially dangerous route conditions, and the features of the present invention are identified in the attached drawings FIGS. 1–5, forming a part of this specification.

The preferred embodiment of the present invention includes the use of a radio frequency transmitter beacon 1 which, when triggered, intermittently transmits a continuous omnidirectional multiplex radio signal which emanates from it's antenna 2. The output radio signal from the transmitter beacon 1 may also be co-broadcast within the Emergency Broadcast System or Emergency Alert Frequencies. The transmitter beacon 2 is securely mounted atop a railroad crossing light and warning bell pole or "crossbuck" 10, and is continually ready to become active.

The transmitter beacon 1 is electrically activated by means of a railroad track mounted sensor switch array 3 which is comprised of an "up track" or forward mounted array and a "down track" or post-crossing mounted array. Pressure from rail traffic engages the electrical contact switch and the switch portion of the pressure sensor switch array 3 controls electrical circuit to activate and deactivate the beacon 1. The sensor switch array 3 is securely mounted to the rail trackage at a given distance coming towards and going away from the rail/highway crossing site. This given distance will vary according to the proposed and dedicated speed of the rail route. The presence of rail traffic on the track causes the up track sensor switch 3 to contact and activate the transmitter beacon 1. As the locomotive and rail car assembly leaves the immediate vicinity of the railroad/highway crossing, the down track array of track mounted sensors 3 will signal the transmitter beacon 1 to shut down. Upon activation of the transmitter beacon 1, a continual multiplex radio signal is presented to all sympathetic receivers within range (1/10–1/4 mile) of the railroad/highway crossing site. The transmitter beacon 1 simultaneously communicates with all local sympathetic in vehicle receivers 4, the local in locomotive receiver 11, and a dedicated centralized recording entity 15, to provide a hard record of individual site system activation. To this end, an external video camera 14 means is incorporated upon selected transmitter beacons 1, which distinct video output signal is recordable by such a centralized recording entity 15. The preferred video camera 14 is similar to the camera on a chip, Mobile View Unit, as is produced by TVX Inc. of Golden Colorado.

The transmitter beacon 1 and the sensor switch array 3 are preferably "hardwired" to the rail trackage electrical system. Alternatively, a self-powered transmitter beacon 1 for use upon unguarded rail crossings would employ a long life battery for electrical power needs, and would have solar photovoltaic cells 6 located nearby the crossbuck 10, to provide for continuous battery charge, and this alternate electrical power method would also be connected to and serve the needs of the sensor switches 3.

For highway motor vehicle use, and for priority vehicle use, the transmitter beacon 1 output radio signal is collected by a signal discriminatory, sympathetic, battery powered receiver unit 4 which is permanently internally mounted into a common rear view mirror 5 present in motor vehicles of all types. Receiver 4 radio frequency collection is augmented by antenna 2 which may be external of receiver 4 outer casing, or internally provided. The receiver 4 microprocessor unit discriminates incoming received radio signals from transmitter beacon 1 located in near proximity, and subsequently relays an electrical discharge to activate one or more of several separately marked and separately colored iconic visual display lights 7, and simultaneously activates an audio chip and speaker 9 for simulated voice within the receiver 4 unit. Both audio and visual display 7 operate in conjunction with one another, to provide a vehicle operator with notification of road hazards, specifically the presence of a hazardous occupied railroad highway crossing. The motor vehicle receiver 4 is additionally capable of receiving incoming radio frequency warning signals from the Emergency Broadcast System or Emergency Alert Frequencies, and Differential Global Positioning System, as necessary. An on/off speaker volume control 8 is so labeled and located upon the receiver 4 outer casing.

Figure 5:
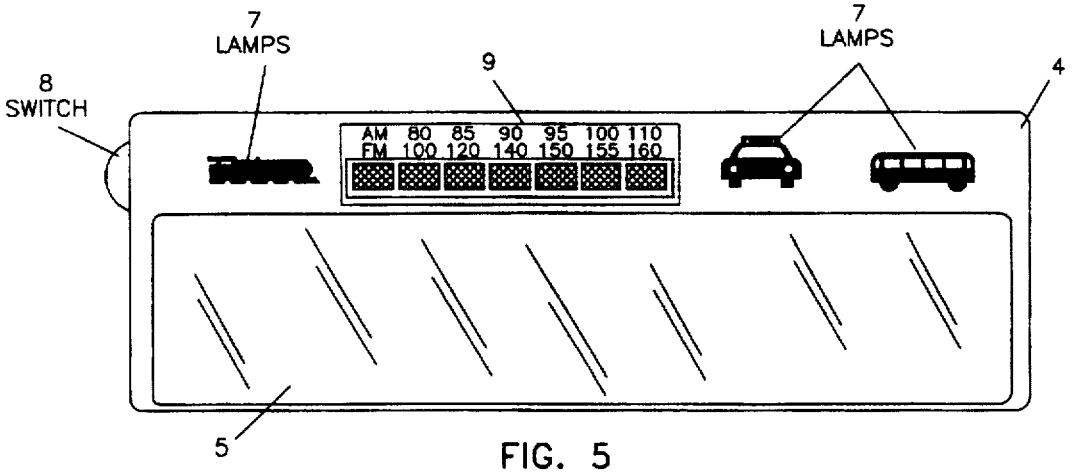
FIG. 5 is a front elevational view of an in-vehicle receiver for motor vehicle use, the receiver incorporated into and within a motor vehicle rear view mirror.

An alternative construction of the present receiver 4 is depicted in the drawings FIG. 5 and would employ the same characteristics and features as the retrofit 5 mirror receiver 4, but this alternative construction would have the receiver 4 mounted atop the rear view mirror 5.

A distinct and separate receiver unit is provided for in-locomotive 11 use, and is permanently mounted within the confines of the locomotive cabin. In-locomotive receiver 11 radio frequency collection is augmented by antenna 2 which may be external of in-locomotive receiver 11 outer casing, or internally provided. The in-locomotive receiver 11 microprocessor unit discriminates incoming received radio signals from transmitter beacon 1 located in near proximity upon the rail route ahead of the locomotive, and subsequently relays an electrical discharge to activate one or more of several separately marked or separately colored visual display lights 7, and simultaneously activates an audio chip and speaker 9 for simulated voice within the in-locomotive receiver 11 unit. Both audio and visual display 7 operate in conjunction with one another to provide the locomotive operator with notification of the activation of the transmitter beacon 1 at the railroad highway crossing. The in-locomotive receiver 11 is additionally capable of receiving incoming radio frequency warning signals from the Emergency Broadcast System or Emergency Alert Frequencies, if necessary.

This in-locomotive receiver 11 unit is connected to a removable event recording means 13 for providing the railroad office with a searchable and downloadable record of route transmitter beacon 1 activations, or transmitter 1 beacon failures, to provide for efficiency in system maintenance. A tape drive or flight recorder type device is utilized for this function, and a cabin microphone may be connected. An on/off speaker volume control 8 is so labeled and located upon the in-locomotive receiver 11 outer casing.

Various changes, additions, and applications other than those specifically outlined herein will become readily apparent to those having ordinary skill in the art, without departing from the spirit and scope of the present invention, and such may be considered to be within the scope and essence of my invention.

Accordingly, it is desired that the scope and essence of my invention be determined not entirely by the foregoing specification, and the embodiments illustrated in the attached drawings, but rather be determined and identified by the hereinafter appended claims and their legal equivalents.

I hereby claim:

1. A system for warning highway vehicles, locomotive operators and motorists of the approach of a locomotive and train into a nearby rail/highway crossing, comprising;

a duality of rail trackage mounted pressure sensor electrical switch arrays, said pressure sensor switch array is mounted to the rail trackage, one sensor switch is mounted to the trackage fore and one sensor switch is mounted to the trackage aft of said rail highway crossing, said sensor switch array is connected to an electrical wiring circuit provided at a rail/highway crossing, said sensor switch array completes an electrical circuit when rail traffic enters the rail crossing, and interrupts the electrical circuit when rail traffic exits the crossing; and a miniature, intermittently active, encased and weatherproofed MHZ multiplex radio frequency transmitter "beacon" unit, powered and hardwired in conjunction with said pressure sensor electrical switch and existing railroad crossing electrical circuitry, the transmitter beacon is mounted to the railroad crossing "crossbuck pole", and said transmitter beacon unit is electrically activated and deactivated by rail traffic activity detected by said rail mounted pressure sensor electrical switch array, said transmitter beacon unit communicates with nearby sympathetic in-vehicle and in-locomotive receivers, said transmitter beacon has a microchip video camera attached, active upon transmitter activation, said transmitter beacon simultaneously provides a companion recordable signal to a centralized, dedicated recording station, which station monitors system performance and fulfillment; and an encased, miniature sympathetic MHZ radio frequency microprocessor receiver unit for highway motor vehicle use, said receiver unit is provided with an enlarged faceplate, said faceplate fully comprises a motor vehicle rearview mirror, said faceplate contains a multiplicity of symbolic illuminated visual display icons with a series of accompanying simulated electronic voice audio warning messages therewithin, upon receiver receipt of the coded radio signal emanating from said rail crossing transmitter beacon, the visual iconic and audio warning messages are coordinated and displayed to present a combined alert signal to the motor vehicle operator, said receiver is a retrofit to fully replace a motor vehicle rear view mirror, and is hardwired to the motor vehicle primary electrical system; and an encased, miniature sympathetic MHZ radio frequency microprocessor receiver unit for in-locomotive use, said receiver unit is provided with a faceplate containing a multiplicity of symbolic illuminated visual display icons, and accompanying simulated electronic voice audio warning messages, upon receiver receipt of the coded radio signal emanating from said rail crossing transmitter beacon, the iconic visual and audio warning messages are co-ordinated and displayed at said receiver to present a combined alert signal to the locomotive and train operator, said receiver is a retrofit for mounting within the cabin of the lead locomotive, and is hardwired to the locomotive electrical system, and said locomotive receiver has an accompanying system event recording means provided, with removable data storage.

2. A system for warning highway vehicles and motorists of the approach of a locomotive and train into a nearby rail/highway crossing according to claim 1, wherein said microchip video camera means is deployed in multiplicity to allow for a wide crossing site view area.

3. A system for warning highway vehicles and motorists of the approach of a locomotive and train into a nearby rail/highway crossing according to claim 1, wherein said motor vehicle receiver is united with an in-vehicle AM/FM/GPS radio receiver.

4. A system for warning highway vehicles, locomotive operators and motorists of the approach of a locomotive and train into a nearby rail/highway crossing, comprising;

a duality of rail trackage mounted pressure sensor electrical switch arrays, said pressure sensor switch array is mounted to the rail trackage, one sensor switch is mounted to the trackage fore and one sensor switch is mounted to the trackage aft of said rail highway crossing, said sensor switch array is connected to an electrical wiring circuit provided at a rail/highway crossing, said sensor switch array completes an electrical circuit when rail traffic enters the rail crossing, and interrupts the electrical circuit when rail traffic exits the crossing; and a battery/solar photovoltaic powered miniature, intermittently active, railroad crossing "crossbuck pole" mounted, encased and weatherproofed MHZ multiplex radio frequency transmitter "beacon " unit, said transmitter beacon unit is electrically activated and deactivated by rail traffic activity detected by said rail mounted pressure sensor electrical switches, said transmitter beacon unit communicates with nearby in-vehicle and in-locomotive sympathetic receivers, said transmitter beacon has a microchip video camera means attached, active upon transmitter activation, said transmitter beacon simultaneously provides a companion signal to a centralized, dedicated recording station, which station monitors system performance and fulfillment; and an encased, miniature sympathetic MHZ radio frequency microprocessor receiver unit for highway motor vehicle use, said receiver unit is provided with an enlarged faceplate, said faceplate fully comprises a motor vehicle rearview mirror, said faceplate contains a multiplicity of symbolic illuminated visual display icons and a series of accompanying simulated electronic voice audio warning messages therewithin, upon receiver receipt of the coded radio signal emanating from said rail crossing transmitter beacon, the visual iconic and audio warning messages are coordinated and displayed to present a combined alert signal to the motor vehicle operator, said receiver is a retrofit to fully replace a motor vehicle rear view mirror, and is hardwired to the motor vehicle primary electrical system; and an encased, miniature sympathetic MHZ radio frequency microprocessor receiver unit for in-locomotive use, said receiver unit is provided with a faceplate containing a multiplicity of symbolic illuminated visual display icons, and accompanying simulated electronic voice audio warning messages, upon receiver receipt of the coded radio signal emanating from said rail crossing transmitter beacon, the iconic visual and audio warning messages are co-ordinated and displayed at said receiver to present a combined alert signal to the locomotive and train operator, said receiver is a retrofit for mounting within the cabin of the lead locomotive, and is hardwired to the locomotive electrical system, and said locomotive receiver has an accompanying system event recording means provided, with removable data storage.

* * * * *